US005413057A

United States Patent [19]

Moore, III

[11] Patent Number: 5,413,057

[45] Date of Patent: May 9, 1995

[54] EMBROIDERY HOOP SET HOLDER AND METHOD

[76] Inventor: E. Frank Moore, III, 4447 Old Randleman Rd., Grensboro, N.C. 27406

[21] Appl. No.: 160,967

[22] Filed: Dec. 3, 1993

[51] Int. Cl.[6] ..... D05C 9/04

[52] U.S. Cl. ..... 112/103; 112/121.12; 112/266.1

[58] Field of Search ..... 112/102, 103, 121.12, 112/121.15, 158, 309; 33/23.01, 2303, 23.06, 23.11; 38/102.2

[56] References Cited

U.S. PATENT DOCUMENTS

| | | | |
|---|---|---|---|
| 671,474 | 4/1901 | Essig | 38/102.2 |
| 2,148,614 | 2/1939 | Gilardone | 112/103 X |
| 3,814,038 | 6/1974 | Dorosz et al. | 112/121 |
| 4,171,672 | 10/1979 | Dorosz et al. | 112/121 |
| 4,357,885 | 11/1982 | Stockton | 112/103 |
| 4,386,573 | 6/1983 | Davidson et al. | 112/103 |
| 4,545,127 | 10/1985 | Barry | 33/180 |
| 4,644,881 | 2/1987 | Schmidt et al. | 112/103 |
| 4,682,551 | 7/1987 | Toman | 112/103 |
| 4,869,183 | 9/1989 | Moore, III | 112/103 |
| 4,932,341 | 6/1990 | Moore, III | 112/103 |
| 4,981,092 | 1/1991 | Bauman et al. | 112/102 X |
| 4,993,333 | 2/1991 | Moore, III | 112/103 |
| 4,998,964 | 3/1991 | Golia | 112/121.12 |
| 5,005,501 | 4/1991 | Kita | 112/103 X |
| 5,144,899 | 9/1992 | Allen | 112/103 |
| 5,228,401 | 7/1993 | Moore, III | 112/103 |
| 5,249,537 | 10/1993 | Sakakibara | 112/103 |

FOREIGN PATENT DOCUMENTS

| | | | |
|---|---|---|---|
| 571419 | 2/1933 | Germany . | |
| 1260052 | 10/1989 | Japan | 112/103 |
| 3130456 | 10/1989 | Japan . | |
| 2264693 | 10/1990 | Japan | 112/103 |
| 4402047 | 1/1992 | Japan | 112/103 |
| 2125073 | 2/1984 | United Kingdom . | |

*Primary Examiner*—Clifford D. Crowder
*Assistant Examiner*—Ismael Izaguirre

[57] ABSTRACT

An embroidery hoop set holder is provided which will double or even more greatly increase the embroidering capacity of an embroidering machine as it provides for a continuous, non-stop operation. The hoop set holder will receive a pair of hoop sets for two garments or the like to allow the sewing head to complete embroidering on one garment while the second garment is being loaded or off-loaded to allow continuous operation and increase production.

18 Claims, 5 Drawing Sheets

EMBROIDERY HOOP SET HOLDER AND METHOD

BACKGROUND OF THE INVENTION

1. Field of the Invention

The invention herein pertains to an apparatus and method for embroidering garments and the like and particularly pertains to apparatus for holding embroidery hoop sets that frame the fabric during the embroidering process.

2. Description of the Prior Art and Objectives of the Invention

There is a greater demand today than ever before for hats, shirts, pants, jackets and other items to bear a trademark, logo or other identifying markings. While printing on items with ink is still used in many instances, consumer demand has increased for high quality, stitched, sewn and embroidered goods for first class, professional markings. Such increased demand has impacted the embroidery trade and many embroidering companies now have single sewing head embroidering machines or multi-head machines which are computer programmed. While multi-head machines have greatly increased production output, such machines are extremely expensive and may cost over $100,000.00 each, thereby limiting their availability to small businesses. Owners of embroidering machinery have had to increase the number of shifts and number of days worked per week to increase their capacity due to growing demands for their products. However sometimes even seven day work weeks of three shifts do not meet seasonal demands of certain customers and unsatisfied customers will sometimes look to foreign suppliers for their embroidering needs.

Some conventional multi-head embroidering machines are designed to embroider with an approximate twelve inch diameter hoop set comprising a large exterior hoop and a smaller interior hoop having the garment sandwiched inbetween at each sewing head or station. Thus, even for small logos (which may be only an inch or two (2.54–5.09 cm) in length and width), the garments are framed with said twelve inch hoop sets, thus wasting much sewing or embroidering space, not to mention the time and labor unnecessarily expended in the framing and loading process. A twelve head embroidering machine requires an operator to hoop frame twelve garments, load them onto the embroidering machine and then activate the computer controls to simultaneously embroider the twelve garments. When the embroidering is completed, the machine terminates movement and the operator then down-loads the embroidered garments and replaces them with new hoop framed garments to carry out the conventional labor intensive process once again.

Thus, with the present problems and disadvantages of conventional embroidering apparatus and methods, the present invention was conceived and one of its objects is to provide an embroidery hoop set holder which will allow a plurality of embroidery hoop sets, each set framing a separate garment to be maintained in the same space that previously was occupied by one large hoop set.

It is another objective of the present invention to provide a method of embroidering and apparatus to allow a single sewing head to embroider two or more garments in sequence without stopping for down-loading.

It is still another objective of the present invention to provide a method of embroidering whereby a single station can be down-loaded and replaced with a fresh garment while a second garment at the same station is being embroidered.

It is also an objective of the present invention to provide an embroidery hoop set holder which will accommodate a plurality of embroidery hoop sets simultaneously.

It is yet another objective of the present invention to provide an embroidery hoop set holder which includes a means to maintain a garment in an open posture during the embroidering process.

It is still further an objective of the present invention to provide an embroidery hoop set holder which includes a fabric guard.

Various other objectives and advantages of the present invention become apparent to those skilled in the art as a more detailed description is set forth below.

SUMMARY OF THE INVENTION

The aforesaid and other objectives are realized by providing an embroidery hoop set holder and method whereby the capacity of a conventional embroidering machine can be more than doubled. The hoop set holder of the invention includes a base having a pair of downwardly depending U-shaped members with blunted wedge-shaped bands affixed thereto. The hoop set holder includes a pair of brackets affixed at each end of the planar base for engaging a receiving arm which is affixed to a pantograph. The hoop set holder increases the capacity of the embroidering process by allowing two garments held in hoop sets to be positioned for embroidering at a single station. In use, as the pantograph moves the first garment beneath the sewing head, the second garment can be loaded or off-loaded while the first garment is being embroidered. After the first garment is embroidered the pantograph moves the second garment into position beneath the sewing head and the first garment can then be off-loaded and a fresh, unembroidered garment positioned in a hoop set for subsequent embroidering.

DESCRIPTION OF THE PREFERRED EMBODIMENT

Figure 4:
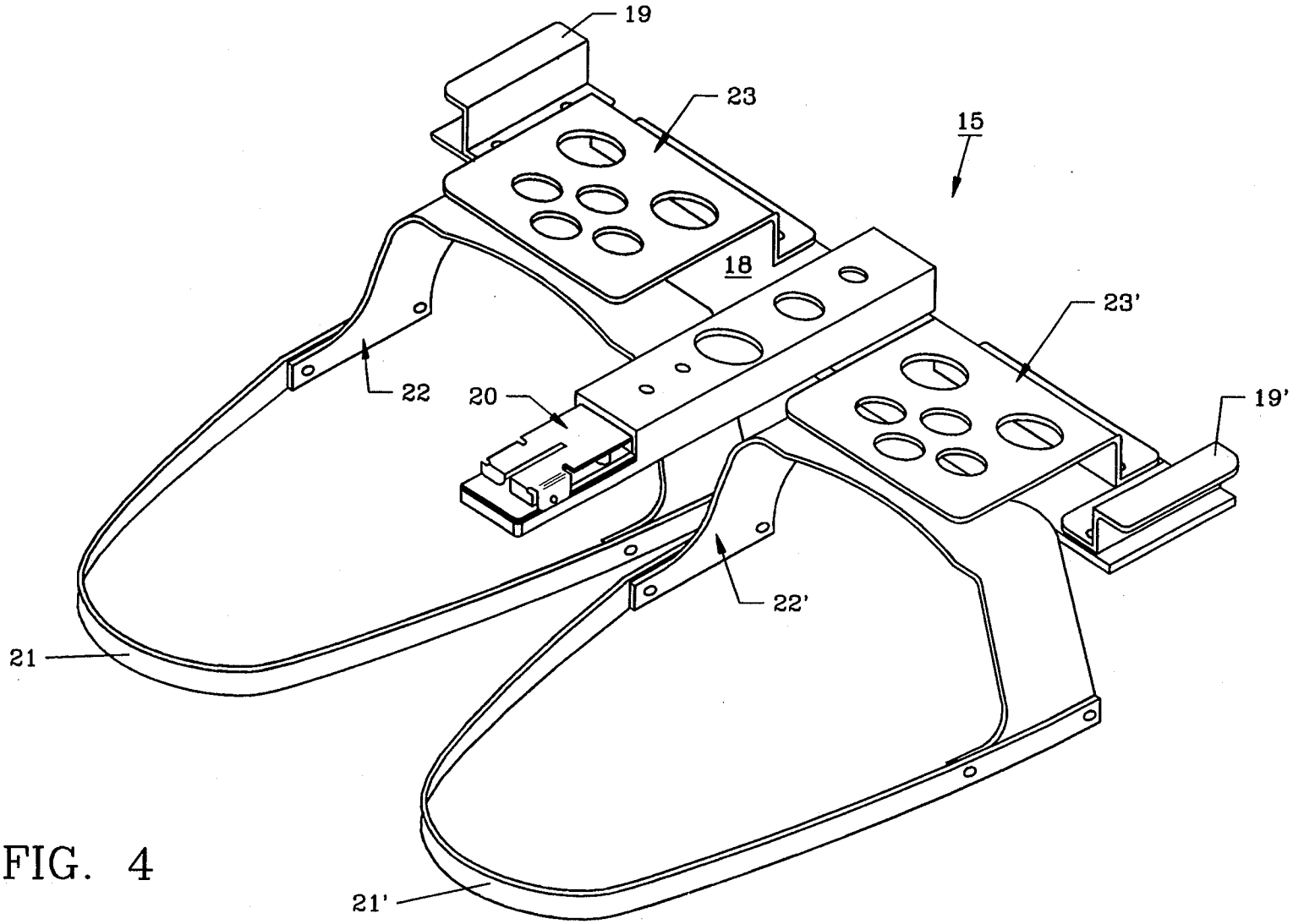
FIG. 4 depicts a perspective close up view of an embroidery hoop set holder containing a pair of embroidery hoop sets as removed from the machine pantograph.

The preferred form of the invention is illustrated in FIG. 4 demonstrating an embroidery hoop set holder formed for retaining a pair of hoop sets for embroidering two garments at one station. The embroidery hoop set holder includes a planar base formed from metal to which inverted U-shaped members having arcuate front edges are attached. Somewhat blunted, wedge-shaped bands made of thin metal are affixed to the U-shaped members to allow garments such as t-shirts to be held in an open posture with the wedge-shaped member inside, between the front and back of the t-shirt to prevent stitching through the back or opposite side of the shirt during embroidering and to facilitate bobbin operation below the hoop sets, within the garment. At each end of the planar base are brackets which, along with the ends of the planar base, form a means to attach the hoop set holder between hoop receiving arms which are affixed to an embroidering machine pantograph. As the hoop receiving arms would conventionally retain a single large embroidery hoop sets, a tubular intermediate hoop receiving arm on the hoop set holder is provided to retain two hoop sets, one set to be positioned on each side thereof, thus doubling the number of hoop sets conventionally employed. A pair of fabric guards are shown attached to the planar base on each side of the intermediate hoop receiving arm to protect the excess or gathered fabric from being caught by the needles of the sewing heads as they pass nearby. The preferred material of the embroidery hoop set holder as shown in FIG. 4 consists of relatively thin aluminum and chrome plated steel with apertures positioned in the upper surfaces of the fabric guards and intermediate arm for weight reduction.

DETAILED DESCRIPTION OF THE DRAWINGS AND OPERATION OF THE INVENTION

Figure 1:
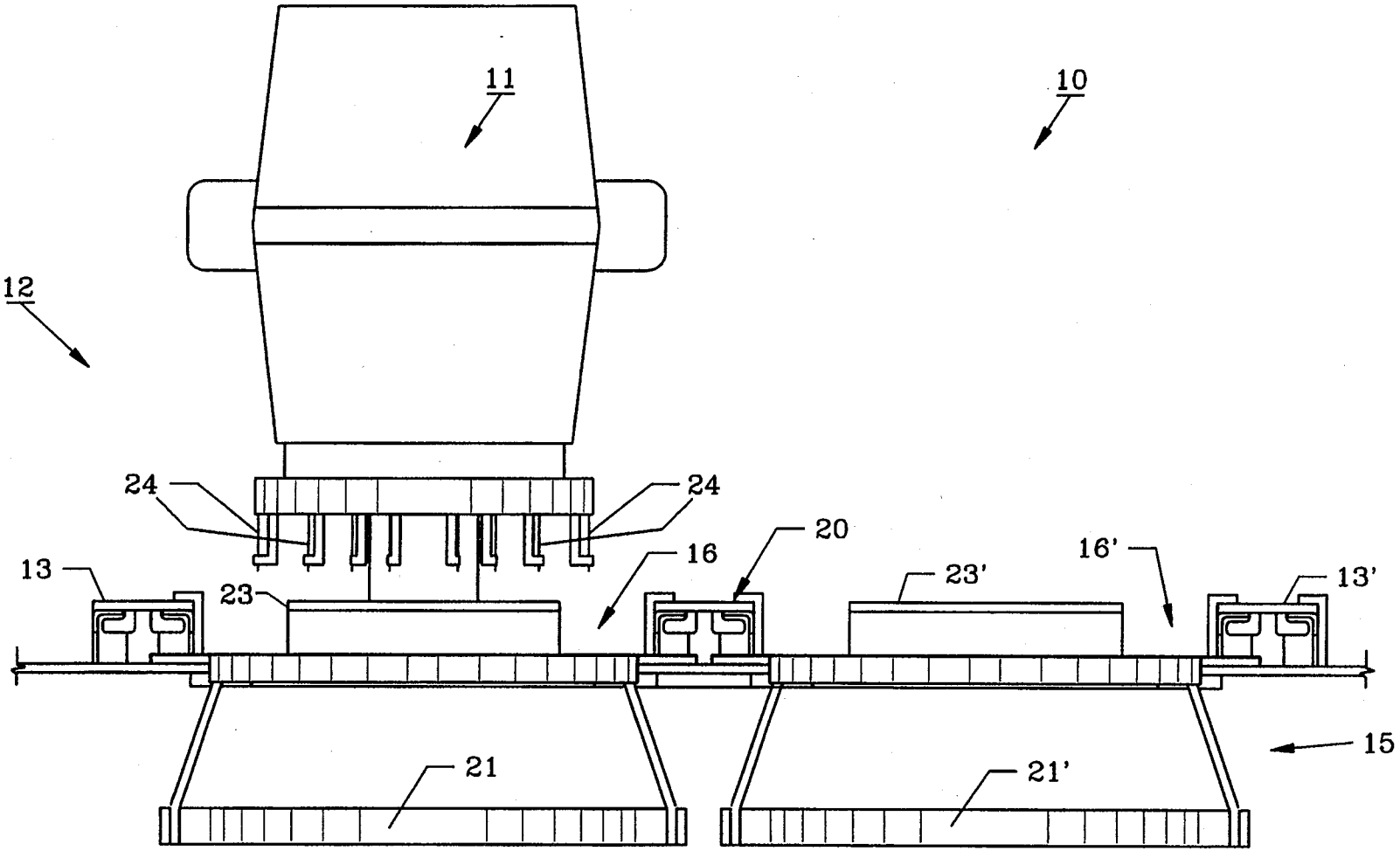
FIG. 1 demonstrates a partial front view of one work station of a conventional multi-head embroidering sewing machine with the embroidery hoop set holder of the invention thereon but with the garments removed from the hoop sets.
Figure 3:
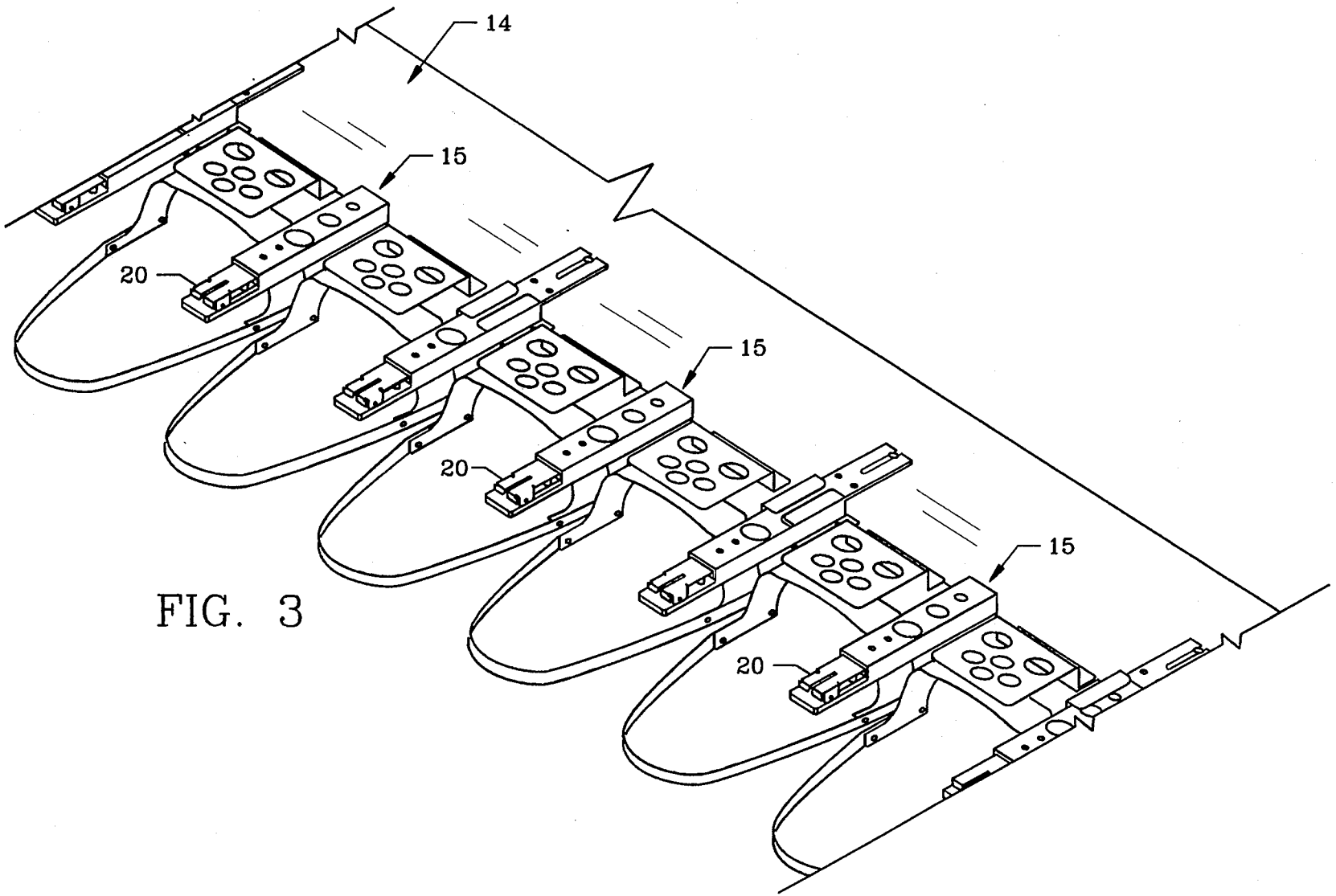
FIG. 3 shows a perspective cut-away view of multiple embroidery hoop set holders of the invention as affixed to a cut-away embroidering machine pantograph with the sewing heads removed for clarity.

For a better understanding of the invention and its operation, turning now to the drawings, FIG. 1 demonstrates a partial view of one station of multi-head embroidering machine 10 which may have, for example, twelve to fifteen sewing heads 11 all joined one to the other and controlled by a microprocessor (not shown) whereby all said heads are synchronized and, for example, twelve jackets could all be embroidered simultaneously with the same company logo. As would be understood, sewing head 11 may utilize multiple needles 24 with the same or a different colored thread for each needle. Each multi-head embroidering machine may have twelve to fifteen sewing heads with each station having its own sewing head 11 and including a pair of embroidery hoop receiving arms 13, 13' affixed to embroidery machine pantograph 14 as shown in FIG. 3. In conventional multi-head embroidering machines, sewing machine pantograph 14 is computer controlled and moves by programmed directions while sewing heads 11 remain stationary. Conventional large embroidery hoop sets are positionable in hoop receiving arms 13, 13' at each station and said usual hoop sets may have a diameter of approximately twelve inches (30.48 cm) to provide a relatively large area for embroidering company logos, names or the like. Thus, in standard practice, a twelve head embroidering machine can only embroider twelve garments such as jackets at one time. While such production is satisfactory under certain circumstances, many times embroidery plants have large orders and additional production is required. Thus, embroidery hoop set holder 15 as shown in FIGS. 1 and 4 doubles the available capacity whereby a multi-head embroidering machine 10 as partially shown in FIG. 1 thereby provides continuous, double production.

Figure 2:
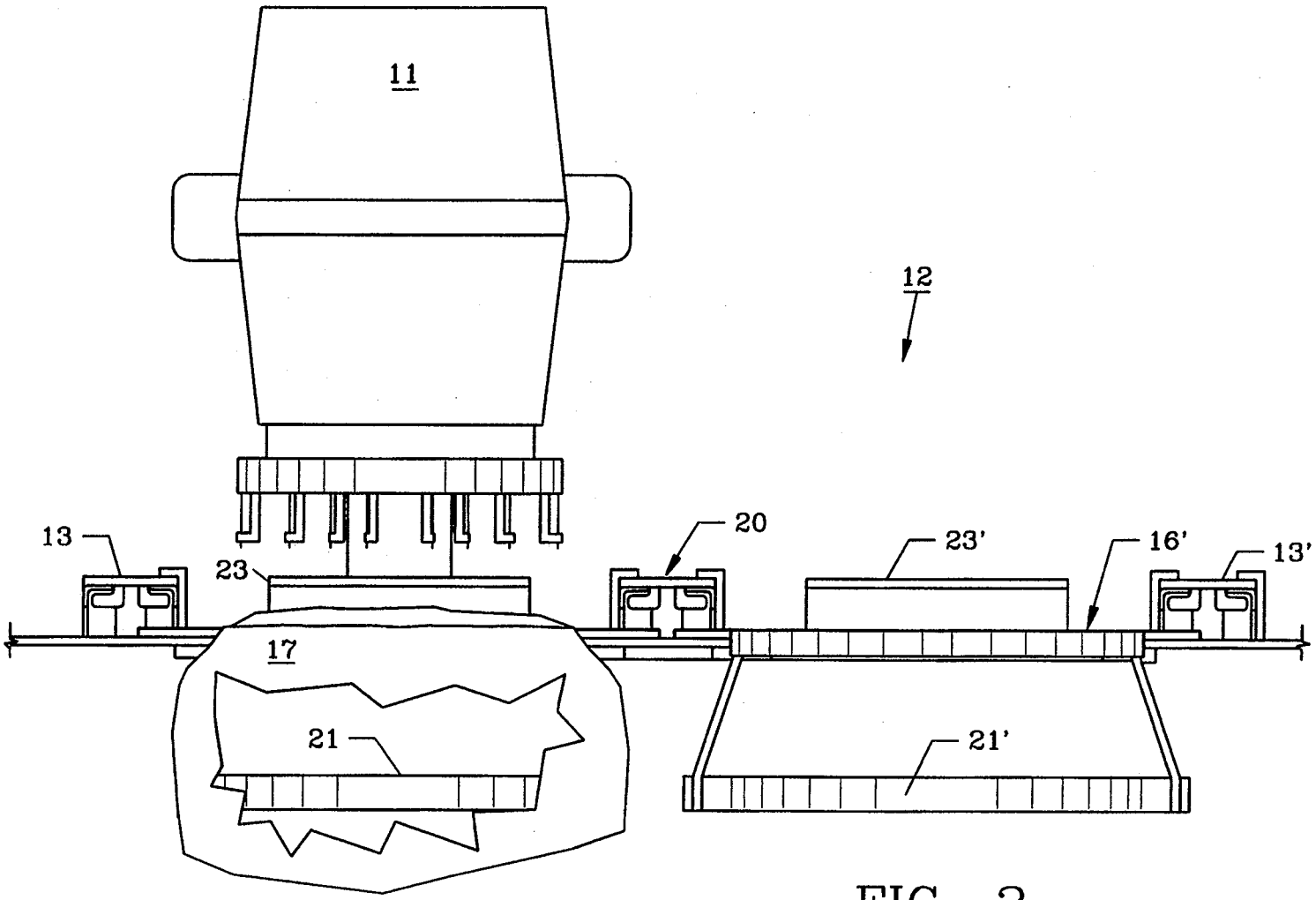
FIG. 2 illustrates the partial sewing station of FIG. 1 with the left side of the hoop set holder loaded with a garment and the right side hoop set unloaded.

Two empty embroidery hoop sets 16, 16' having a diameter of approximately four and one-half inches (11.43 cm) are shown loaded into hoop set holder 15 in FIG. 1. Shirt 17 as shown in FIG. 2 can be positioned within embroidery hoop set 16 while embroidery hoop set 16' is removed (off-loaded) from hoop set holder 15 when the logo or emblem embroidering is completed. The machine operator can initially load all hoop sets 16, 16' at each of the stations 12 and begin the embroidering operation. As the sewing heads 11 complete the embroidering on first shirt 17 within one of the embroidery hoop sets 16, pantograph 14 moves the second embroidery hoop set 16' beneath sewing head 11 where it repeats its sewing operation on the second garment. After first shirt 17 as contained within embroidery hoop set 16 has been embroidered, the operator can then remove the embroidered shirt 17 and replace it in the embroidery hoop set holder 15 with a fresh, unembroidered third shirt (not shown) while the second shirt (not shown) is being embroidered. The operation is thus continuous for loading and off-loading garments while the machine remains in operation to thereby significantly increase the production of a single, multi-head embroidering machine. The capacity of a single machine is more than doubled by using hoop set holder 15, but could be further increased with the addition of more intermediate hoop receiving arms to accommodate more hoop sets between hoop receiving arms 13, 13'.

Figure 5:
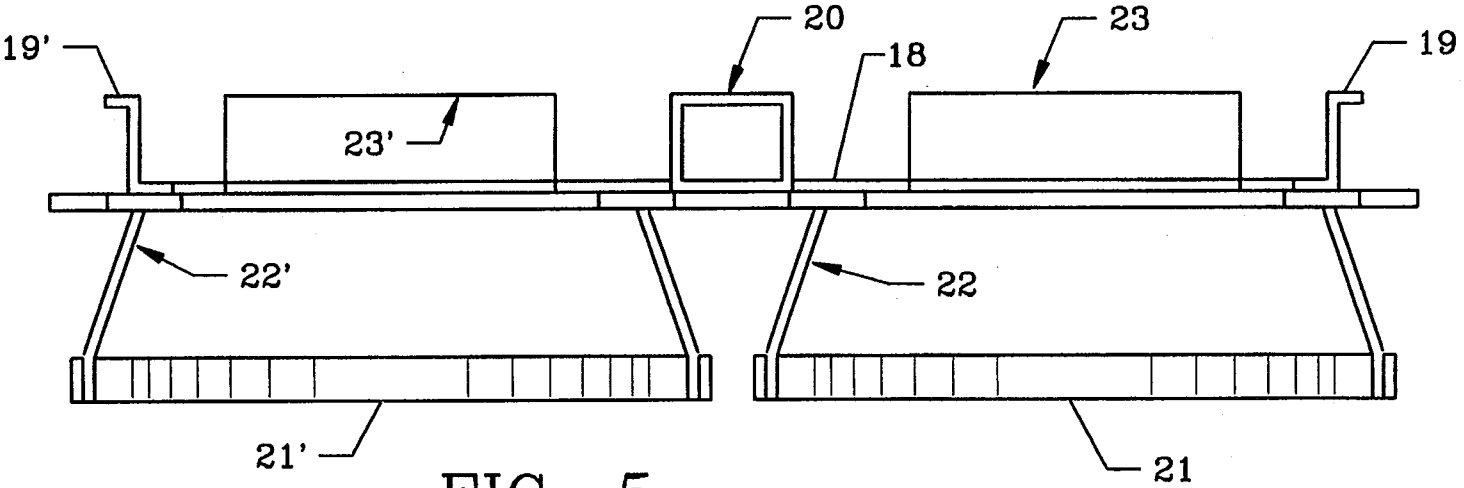
FIG. 5 pictures a rear elevational view of the embroidery hoop set holder as seen in FIG. 4.

As shown in FIG. 4, embroidery hoop set holder 15 is sized to accommodate two embroidery hoop sets, however, hoop set holder 15 can be configured to hold only one or a plurality of hoop sets of the same or varying sizes as desired. Embroidery hoop set holder 15 as seen in FIG. 4 includes an elongated planar base 18 which may be formed from three-sixteenths inch (3/16") (4.76 cm) aluminum which may have been anodized for durability and appearance. Attached at both ends of elongated planar base 18 are brackets 19, 19' to provide a means for securely attaching hoop set holder 15 to sewing machine pantograph 14. Brackets 19, 19' are formed from a thin, yet rigid metal which may be steel which has been chrome plated. Tubular intermediate hoop receiving arm 20 receives both embroidery hoop sets 16, 16' as shown in FIG. 1 for support purposes during embroidering. Many garments are difficult to handle while loading on an embroidering machine such as t-shirts which must be opened or spread apart so the embroidering can be completed, for example, on the front of the t-shirt without the sewing needles penetrating the rear or the back of the shirt and to provide space for bobbin operation. To assist in this "opening" of such garments, a means are provided to open the shirts in the form of wedge-shaped, loop-like members 21, 21' as shown in FIG. 4. Loop-like opening members 21, 21' may be chrome plated steel which has been polished to remove all irregular edges and burrs which may snag garments placed thereon. Wedge-shaped opening members 21, 21' are affixed to planar base 18 via inverted U-shaped members 22, 22' respectively, also seen in FIG. 4. Positioned above U-shaped members 22, 22' and planar base 18 are fabric guards 23, 23' to receive excess fabric which extends beyond framing hoop set 16 to planar base 18. Such excess fabric can be conveniently tucked under fabric guard 23 to prevent it from catching on sewing head needles 24 as seen in FIG. 1. Fabric guards 23, 23' are affixed to planar base 18 and are porous to reduce their weight without sacrificing their strength. As seen in FIG. 5, fabric guards 23, 23' extend above base 18 and are positioned on each side of intermediate hoop receiving arm 20.

The illustrations and examples provided herein are for explanatory purposes and single head embroidering machines may also be used with the invention described herein and other items, other than garments could also be embroidered utilizing the methods and apparatus described. Such illustrations and examples are not intended to limit the scope of the appended claims.

I claim:

1. Apparatus for an embroidering machine having a sewing head, said apparatus for releasably maintaining a plurality of embroidery hoop sets for said sewing head, said hoop sets for holding embroidable fabric, said embroidering machine having a pair of conventional hoop receiving arms for said sewing head affixed to the embroidering machine, said apparatus comprising: an elongated base, means to releasably attach said base between a pair of conventional hoop receiving arms, an intermediate hoop receiving arm, said intermediate hoop receiving arm positioned between said pair of conventional hoop receiving arms, said intermediate arm for receiving a plurality of embroidery hoop sets between said pair of conventional hoop receiving arms, and, a means to open fabric layers to accommodate needle passage, said fabric opening means joined to said elongated base.

2. Apparatus as claimed in claim 1 and including a fabric guard, said fabric guard attached to said base.

3. Apparatus as claimed in claim 1 and including an inverted U-shaped member, said U-shaped member joined to said base and to said fabric opening means, said U-shaped member spacing said fabric opening means from said base.

4. Apparatus as claimed in claim 3 wherein said fabric opening means is wedge-shaped.

5. Apparatus as claimed in claim 1 wherein said intermediate hoop receiving arm is positioned between said pair of conventional hoop receiving arms in order to receive two embroidery hoop sets per sewing head simultaneously.

6. Apparatus as claimed in claim 1 wherein said apparatus attaching means comprises a bracket.

7. Apparatus for an embroidering machine having a sewing head, said apparatus for releasably maintaining a plurality of embroidery hoop sets for said sewing head on an embroidering machine having first and second conventional hoop receiving arms forming a pair of conventional hoop receiving arms for said sewing head, in order to increase the number of available hoop sets thereon comprising: an elongated base, said base having a pair of ends, means to attach said base between said conventional hoop receiving arms, said attaching means affixed at both ends of said base, an intermediate hoop receiving arm, said intermediate hoop receiving arm attached to said base between said ends of said base, a means to open fabric layers, and said fabric opening means joined to said elongated base, said fabric opening means comprising a rounded end whereby a first embroidery hoop set is maintained in place between said intermediate hoop receiving arm and said first conventional hoop receiving arm and a second embroidery hoop set is maintained in place between said intermediate hoop receiving arm and said second conventional hoop receiving arm.

8. Apparatus as claimed in claim 7 and including a fabric guard, said fabric guard attached to said base.

9. Apparatus as claimed in claim 7 and including a U-shaped member, said U-shaped member joined to said elongated base and to said fabric opening means, said U-shaped member spacing said fabric opening means from said elongated base.

10. Apparatus as claimed in claim 9 wherein said fabric opening means is wedge-shaped.

11. Apparatus as claimed in claim 10 wherein said wedge-shaped fabric opening means comprises a thin band.

12. Apparatus for an embroidering machine having multiple sewing heads, said apparatus for releasably maintaining a plurality of embroidery hoop sets per sewing head on an embroidering machine utilizing a pantograph with first and second conventional hoop receiving arms to increase the number of available hoop sets per sewing head thereon comprising: an elongated base, said base having a pair of ends, means to attach said base to said conventional hoop receiving arms, said attaching means affixed at both ends of said base, an intermediate hoop receiving arm, said intermediate hoop receiving arm attached to said base between said ends of said base, a fabric guard, said fabric guard attached to said base, a means to open fabric to allow needle accommodation during embroidering, said fabric opening means joined to said elongated base whereby a first embroidery hoop set is maintained in place by said intermediate arm and said first conventional hoop receiving arm and a second embroidery hoop set is maintained in place by said intermediate arm and said second conventional hoop receiving arm.

13. Apparatus as claimed in claim 12 wherein said base is planar.

14. Apparatus as claimed in claim 12 wherein said intermediate arm is tubular.

15. A method of converting an embroidering machine having a singular hoop set per sewing head so that said embroidering machine utilizes a plurality of hoop sets per sewing head, said embroidering machine having first and second conventional hoop receiving arms spaced apart to hold a singular hoop set therebetween, while maintaining the embroidable fabric in an open posture to accommodate needle movement, said embroidering machine having a computer controlled pantograph, the method comprising the steps of:

(a) removing the singular hoop set from said first and second conventional hoop receiving arms; and (b) attaching a multiple hoop set holder to said first and second conventional hoop receiving arms.

16. The method of claim 15 and including the steps of (a) loading a first garment that has been hooped into the multiple hoop set holder;

(b) loading a second garment that has been hooped into the multiple hoop set holder;

(c) maintaining the fabric in an open posture;

(d) embroidering the first hooped garment;

(e) embroidering the second hooped garment; and (f) off-loading the first garment prior to completion of the embroidering of said second hooped garment.

17. The method of claim 16 and including the step of loading a third hooped garment into the multiple hoop set holder prior to completion of embroidering of said second garment.

18. The method of claim 16 wherein the step of attaching a multiple hoop set holder comprises the step of attaching a multiple hoop set holder to the pantograph.

* * * * *